US006203351B1

(12) United States Patent
Okabe

(10) Patent No.: US 6,203,351 B1
(45) Date of Patent: Mar. 20, 2001

(54) CONNECTOR LOCKING STRUCTURE

(75) Inventor: Toshiaki Okabe, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/115,271

(22) Filed: Jul. 14, 1998

(30) Foreign Application Priority Data

Jul. 14, 1997 (JP) ..... 9-188606

(51) Int. Cl.[7] ..... H01R 13/627
(52) U.S. Cl. ..... 439/352; 439/347
(58) Field of Search ..... 439/347, 350–358, 439/488, 489

(56) References Cited

U.S. PATENT DOCUMENTS

| | | | | |
|---|---|---|---|---|
| 4,634,204 | * | 1/1987 | Detter et al. | 439/352 |
| 4,884,978 | * | 12/1989 | Inaka et al. | 439/352 |
| 5,236,373 | * | 8/1993 | Kennedy | 439/352 |
| 5,605,471 | * | 2/1997 | Plyler | 439/352 |
| 5,628,648 | * | 5/1997 | Higgins et al. | 439/352 |
| 5,720,623 | * | 2/1998 | Polenick et al. | 439/352 |
| 5,722,849 | * | 3/1998 | Alwine | 439/352 |
| 5,820,395 | * | 10/1998 | Stabroth et al. | 439/352 |

FOREIGN PATENT DOCUMENTS

| | | | |
|---|---|---|---|
| 62-176987 | 11/1987 | (JP) | H01R/13/639 |
| 63-20378 | 2/1988 | (JP) | H01R/13/639 |
| 5-1178 | 1/1993 | (JP) | H01R/13/639 |

* cited by examiner

*Primary Examiner*—Hien Vu
(74) *Attorney, Agent, or Firm*—Sughrue, Mion, Zinn, Macpeak & Seas, PLLC

(57) ABSTRACT

In the connector locking structure, there are provided engaging projections 11 in a male connector housing 10, in a hood portion 21 of a female connector housing 20 which the male connector housing 10 can be fitted into and removed from, there are formed insertion grooves 25 through which the engaging projections 11 can be inserted and, at the same time, there is provided a slide member 30 including a plurality of flexible securing projections 34 engageable with the engaging projections 11 of the male connector housing 10 in such a manner that the slide member 30 can be freely moved by operating or pressing an operation portion 31 thereof, whereby, if the flexible securing projections 34 of the slide member 30 are respectively engaged with the engaging projections 11 of the male connector housing 10, then the fitting engagement between the two connector housing 10 and 20 can be locked.

Especially, in the present connector locking structure, in the male connector housing 10, there are formed a plurality of engaging projections 11 and, in the portion of the hood portion 21 of the female connector housing 20 that is located opposed to the engaging projections 11, there are formed a corresponding number of insertion grooves 25.

5 Claims, 8 Drawing Sheets

CONNECTOR LOCKING STRUCTURE

BACKGROUND OF THE INVENTION

1. Field of the Invention

The present invention relates to a connector locking structure in which a slide member including a flexible securing projection is mounted on a female connector housing, and the mutually fitting engagement between the male and female connector housings can be locked or unlocked by moving the slide member.

2. Related Art

Conventionally, as shown in FIG. 11, in a connecting structure for connecting a male connector 1 on the wire harness side and a female connector 5 on the equipment side, a lock arm 3 is provided on a male connector housing 2 formed of synthetic resin in such a manner that the lock arm 3 is formed integrally with the male connector housing 2 and, similarly, an engaging projection 7 corresponding to the lock arm 3 is provided on a female connector housing 6, whereby the two connectors 1 and 5 are fitted with and locked to each other.

[0003]

Especially, since a heat resistance property must be given to the female connector housing 6 on the equipment side, the lock arm 3, which is highly flexible, in most cases, cannot be formed of heat-resisting resin. Also, when the lock arm 3 is provided on the female connector housing 6 on the equipment side, the efficiency of an operation when removing the locked condition of the male and female connectors 1 and 5 is poor. This is the reason why the lock arm 3 including a removal operation portion 4 is provided on the male connector 1 on the wire harness side.

However, in the above-mentioned conventional connecting structure, since the lock arm 3 projects from the male connector housing 2, the male connector 1 is enlarged in size to thereby increase the size of the whole connector; and, because the lock arm 3 can be easily interfered, there is a fear that the locked condition of the two male and female connectors 1 and 5 can be removed inadvertently.

SUMMARY OF THE INVENTION

The present invention aims at eliminating the problems found in the above-mentioned conventional connecting structure. Accordingly, it is an object of the invention to provide a small-sized connector locking structure in which not only the operation of an operation portion of a slide member mounted on a female connector housing can be executed smoothly, but also the locking and unlocking of the fitting engagement between two male and female connector housings can be executed easily and positively.

In attaining the above object, according to the present invention, there is provided a connector locking structure in which the engaging projection is formed in the male connector housing, and, in the hood portion of the female connector housing with which the male connector housing can be removably fitted, not only there is formed the insertion groove through which the engaging projection can be inserted, but also there is provided a slide member which includes a flexible securing projection engageable with the engaging projection and also which can be freely moved by operating or pressing the operation portion thereof, whereby, if the flexible securing projection of the slide member is engaged with the engaging projection of the male connector housing, then the fitting engagement between the two male and female connector housing can be locked, characterized in that the number of the engaging projections of the male connector housing is two or more, and the number of the insertion grooves of the female connector housing is so set as to correspond the number of the engaging projections of the male connector housing, while the insertion grooves are respectively formed at the given positions of the hood portion of the female connector housing that are respectively disposed opposed to their associated engaging projections.

With use of the present connector locking structure, in the mutual fitting engagement between the male and female connector housings, the plurality of engaging projections of the male connector housing are respectively restricted in position by the plurality of insertion grooves of the hood portion of the female connector housing, so that the male connector housing can be moved smoothly in a linear manner with respect to the female connector housing. This makes it sure to prevent the deformation and the like of the connector terminals.

According to the present invention, the flexible securing projections corresponding in number to the engaging projections of the male connector housing are respectively provided in the slide member.

With use of the present connector locking structure, in the connector locked condition in-which the plurality of engaging projections of the male connector housing are respectively engaged with the flexible securing projections of the slide member, a sufficient locking strength is secured and, when removing such locked condition, the slide member may be moved by an amount equivalent to one engaging projection. As a result of this, the space necessary for the movement of the slider member can be reduced and thus the whole connector can be made more compact by an amount corresponding to the reduction of the slider member movement space.

According to the present invention, there is provided a connector locking structure as set forth in claim 1, characterized in that the plurality of guide ribs are formed projectingly and integrally in the hood portion of the female connector housing to thereby form the plurality of insertion grooves.

With use of the present connector locking structure, since the male connector housing can be moved smoothly in a linear manner with respect to the female connector housing through the guide ribs forming the plurality of insertion grooves of the hood portion of the female connector housing, the deformation and the like of the connector terminals can be surely prevented.

DETAILED DESCRIPTION OF THE PREFERRED EMBODIMENTS

Figure 1:
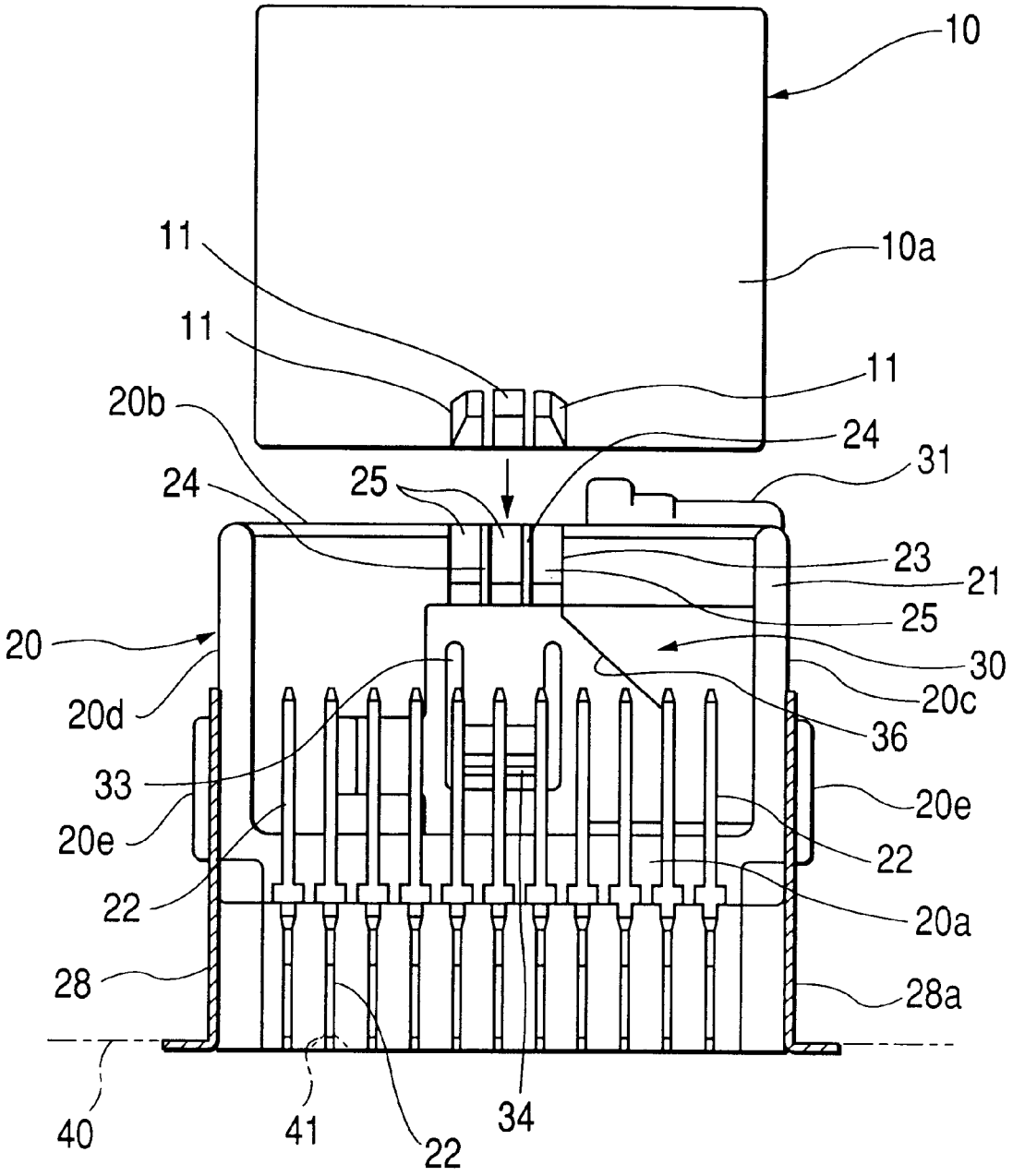
FIG. 1 is an explanatory view of a connector locking structure according to an embodiment of the invention, showing a state thereof before two male and female connector housings are fitted with each other.

Now, description will be given below of an embodiment of a connector locking structure according to the invention with reference to the accompanying drawings.

FIGS. 1 to 10 respectively show a concrete example of an embodiment of a connector locking structure according to the invention.

In the present locking structure, there are provided engaging projections 11 in a male connector housing 10 disposed on the wire harness side; in a hood portion 21 of a female connector housing 20 which is disposed on the equipment side (base plate side) and also which the male connector housing 10 can be fitted into and removed from, there are formed insertion grooves 25 through which the engaging projections 11 can be inserted respectively and, at the same time, there is provided a slide member 30 including flexible engaging projections 34 respectively engageable with the engaging projections 11 in such a manner that the slide member 30 can be freely moved by operating or pressing an operation portion 31 of the slide member 30; and, if the flexible securing projections 34 of the slide member 30 are respectively engaged with the engaging projections 11 of the male connector housing 10, then the fitting engagement of the two connector housings 10 and 20 can be locked.

Figure 6A:
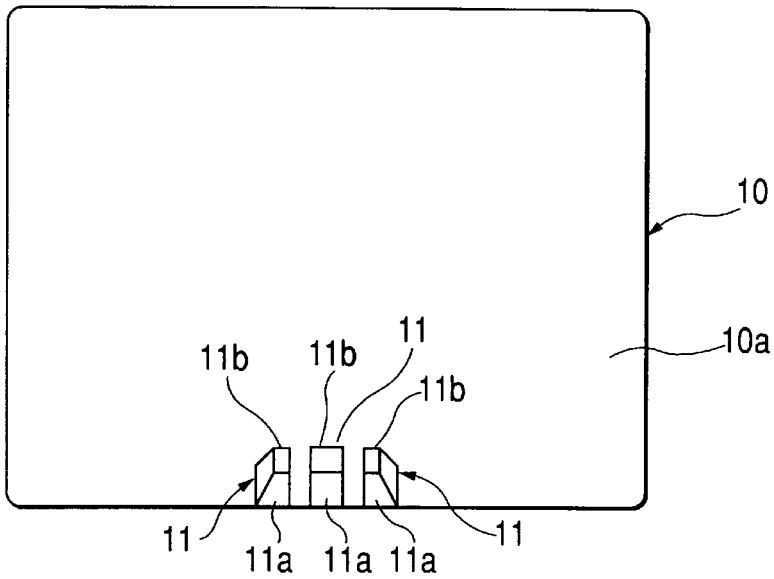
FIG. 6(*a*) is a plan view of the male connector housing, FIG. 6(*b*) is a front view of the male connector housing, and FIG. 6(*c*) is a side view of the male connector housing.
Figure 6B:
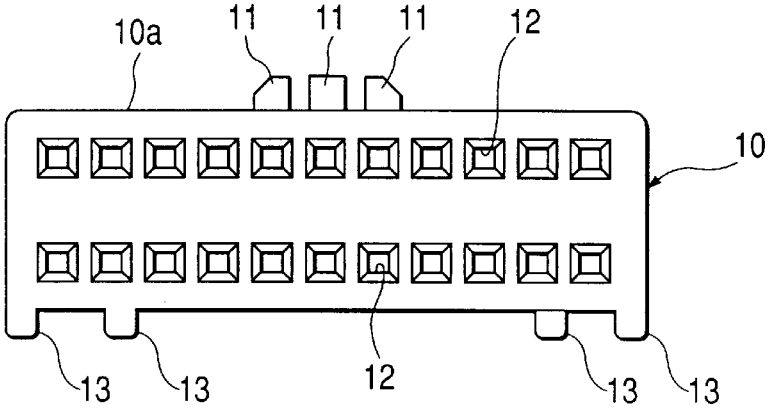
Figure 6C:
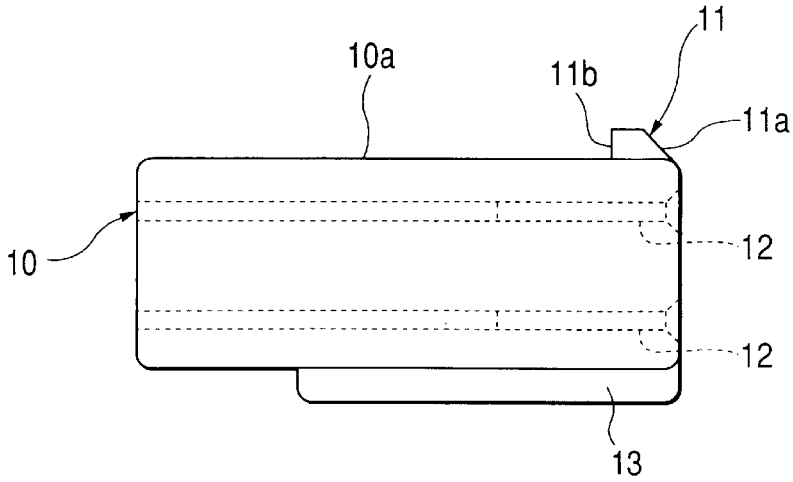

As shown in FIG. 1 as well as FIGS. 6(*a*), (*b*) and (*c*), the male connector housing 10 is formed in a block made of synthetic resin, while the three engaging projections 11 are formed in the central portion of the front side of the upper surface 10*a* of the male connector housing 10 in such a manner that they projects at regular intervals integrally with the upper surface 10*a*. Also, each of the three engaging projections 11 has a front surface which is formed as an inclined surface 11*a*, while the rear surface of each engaging projection 11 is formed as an inclined surface 11*b* next to a vertical surface. Further, in the right and left engaging projections 11, the outside corner portions of the rear sides thereof are respectively cut away. As shown in FIG. 6(*b*) and (*c*), in the male connector housing 10, there are formed a plurality of terminal storage chambers 12 in two upper and lower stages, while female terminals (not shown) are respectively stored within their associated terminal storage chambers 12. To the respective female terminals, there are connected electric wires (not shown) which form a wire harness. And, a pair of leg portions 13 and 13 are projectingly formed on each of the two sides of the bottom portion of the male connector housing 10.

As shown in FIGS. 1 to 5, the female connector housing 20 is formed of synthetic resin and includes, on the front side thereof, the square-cylinder-shaped hood portion 21 which is used as a connector fitting or engaging chamber. Into the interior portion of the hood portion 21, there are projected a plurality of male tab terminals (terminals) 22 which are respectively pressure inserted into the base portion 20*a* of the female connector housing 20. Also, at the central position of the hood portion 21 that corresponds to the three engaging projections 11 of the male connector housing 10, there is formed a recessed portion 23. In the recessed portion 23, there are provided two guide ribs 24 integrally with the recessed portion 23 and, between the recessed portion 23 and guide ribs 24, there are respectively formed three insertion grooves 25 through which the engaging projections 11 can be respectively inserted. Further, on the two sides of the lower wall portions of the hood portion 21, there are formed a pair of guide grooves 26 and 26 into each of which the pair of leg portions 13 and 13 provided on either side of the bottom surface of the male connector housing 10 can be inserted.

Figure 2:
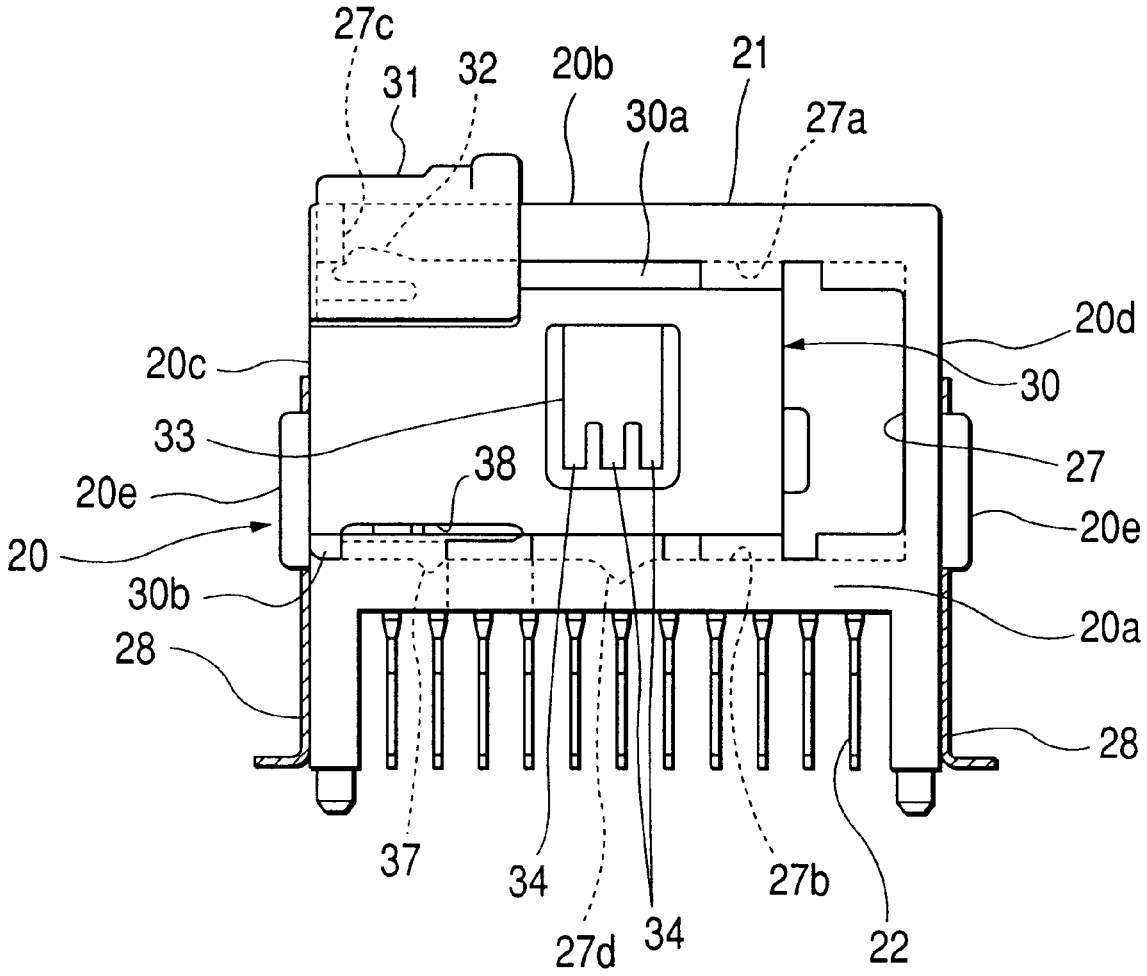
FIG. 2 is a plan view of the female connector housing.

As shown in FIG. 2, on the flat surface side of the female connector housing 20, there is formed a rectangular-shaped opening 27 and, in the upper and lower edges of the opening 27, there are formed a pair of U-shaped guide grooves 27*a* and 27*b*. On the upper side of one end of the upper guide groove 27*a* (in FIG. 2, on the upper left side), there is formed a square-cylinder-shaped guide groove 27*c* in such a manner that it can communicate with the guide groove 27*a*. Also, in the central portion of the lower guide groove 27*b*, there is formed an engaging recessed portion (an engaging portion) which is recessed in an inverted-triangular-prism shape. And, the left and right side surfaces 20*c* and 20*d* of the female connector housing 20 are formed equal in length to the male tab terminals and extend downward and, in the respective central portions of the two side surfaces 20*c* and 20*d*, there are provided a pair of bracket portions 20*e* and 20*e* in such a manner that they are formed integrally with their respective side surfaces 20*c* and 20*d*. In each of the pair of bracket portions 20*e* and 20*e*, there is provided an L-shaped fixing metal member 28 including an elongated hole 28*a* in the central portion thereof in such a manner that the fixing metal member 28 can be freely lifted and lowered.

Figure 7A:
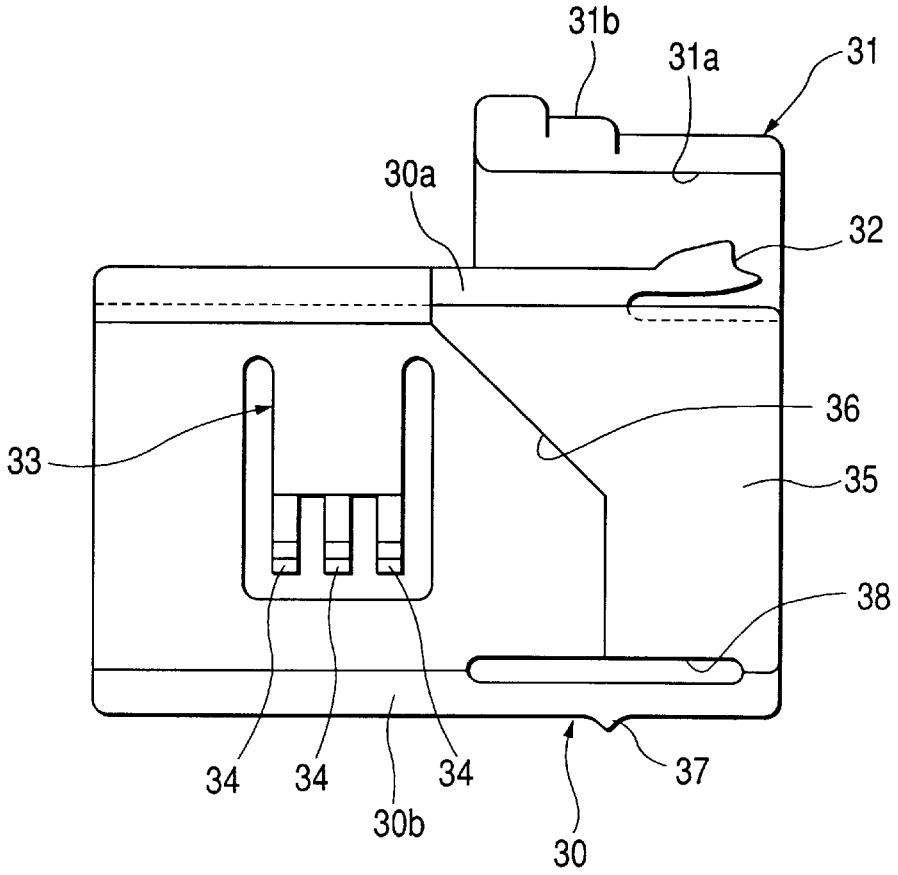
FIG. 7(*a*) is a view of a slide member to be mounted on the female connector housing, when it is viewed from the inside thereof, and FIG. 7(*b*) is a bottom view of the slide member.
Figure 7B:
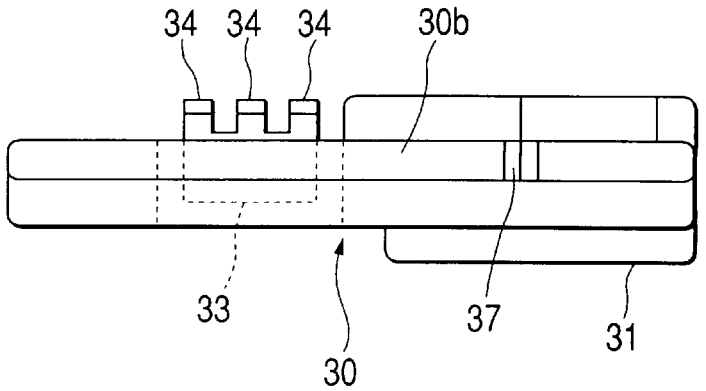
Figure 8:
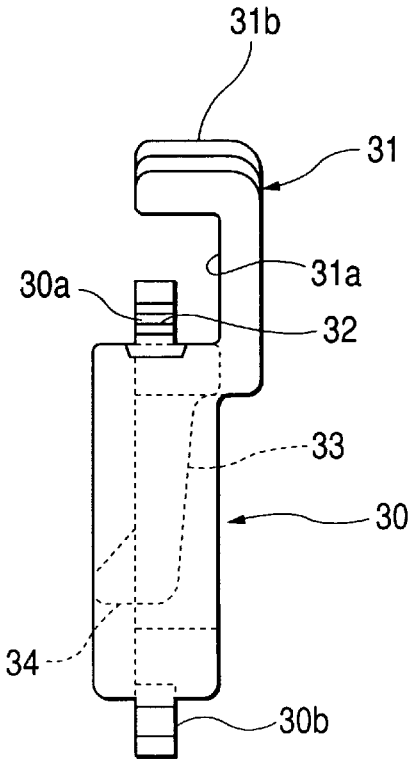
FIG. 8 is a side view of the slide member.

As shown in FIGS. 2, 7 and 8, the slide member 30 is formed of synthetic resin into a substantially rectangular-shaped plate, and includes, in the central portions of the upper and lower end faces thereof, rail portions 30*a* and 30*b* which are respectively supported in a freely slidable manner by the upper and lower guide grooves 27*a* and 27*b* of the opening 27 of the female connector housing 20. Also, on the left end side (in FIG. 2) of the upper rail portion 30*a*, there is formed an operation part 31 having a U-shaped side surface in such a manner that it projects upward from and is formed integrally with the slide member 30. In the interior portion of the operation portion 31, there is formed a guide groove 31*a* which supports the operation or pressing force of the operation portion 31 on the upper end face (one surface) and flat surface sides of the female connector housing 20. The U-shaped guide groove 31*a* can be slided along the upper end face and flat surface of the female connector housing 20. Also, in the central portion of the lower surface of the guide groove 31*a* of the operation portion 31 (a portion of the upper rail portion 30*a*), there is projectingly and integrally formed a securing projection 32 for removal prevention; that is, by inserting the removal preventive securing projection 32 into the guide groove 27*c* formed on the upper surface 20*b* side of the female connector housing 20, the slide member 30 is prevented against removal from the female connector housing 20.

Also, substantially in the central portion of the slide member 30, there is provided a flexible lock arm 33 through a U-shaped notch. On the leading end side of the lock arm 33, there are formed three flexible securing projections 34 which respectively correspond to the engaging projections 11 of the male connector housing 10. Further, a portion of the slide member 30 existing between the removal preventive securing projection 32 and lock arm 33 is formed larger in thickness than the remaining portions thereof and, at the position of the large thickness portion 35 that is near to the lock arm 33, there is formed a tapered surface 36 which is inclined at an angle of approx. 45° C. and is used for connector fitting engagement. And, if the slide member 30 is moved, then the tapered surface 36 of the slide member 36 is engaged with the engaging projections 11 of the male connector housing .10, so that the male connector housing 10 can be thereby fitted into the hood portion 21 of the female connector housing 20.

Further, at the position of the lower rail portion 30*b* of the slide member 30 that is opposed to the operation portion 31, there is projectingly and integrally formed a triangular-prism-shaped securing projection (securing portion) 37 which can be secured to and removed from the engaging recessed portion 27*d* of the female connector housing 20, while the securing projection 37 portion of the slide member 30 can be elastically deformed through an elongated hole 38 so opened up as to be parallel to the lower rail portion 30*b*. Also, the upper surface of the operation portion 31 of the slide member 30 provides an operation surface 31*b* which is formed as a stepped portion.

Figure 9A:
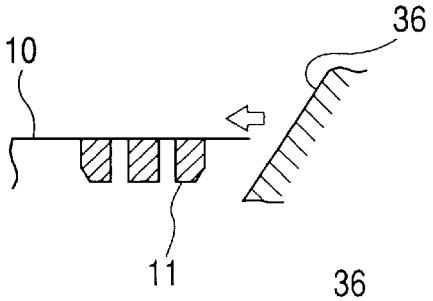
FIG. 9(*a*) is an explanatory view of the engaging projections of the male connector housing and the connector fitting tapered surface of the slide member, showing a state thereof before they are engaged with each other, FIG. 9(*b*) is an explanatory view of the above elements, showing a state thereof when they are engaged with each other, and FIG. 9(*c*) is an explanatory view of the above elements, showing a state thereof while they are being engaged with each other.
Figure 9B:
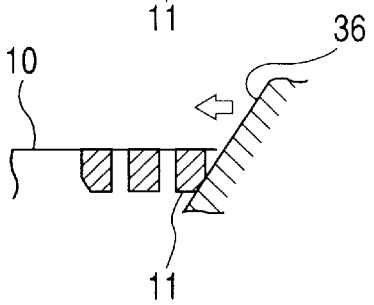
Figure 9C:
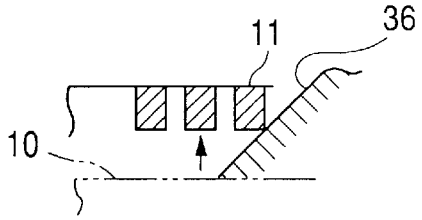

Now, description will be given below of the fitting or engaging operation of the thus constructed connector locking structure. As shown in FIG. 1, if the male connector housing 10 is inserted into the hood portion 21 of the female connector housing 20, then the engaging projections 11 of the male connector housing 10 are respectively inserted through their associated insertion grooves 25 of the hood portion 21. And, if the operation portion 31 of the slide member 30 is operated or pressed toward the right side surface 20*d* side of the female connector housing 20, then as shown in FIGS. 9 (*a*) to (*c*), the connector fitting tapered surface 36 of the slide member 30 is engaged with the engaging projections 11 of the male connector housing 10, so that the male connector housing 10 is thus pulled toward the female connector housing 20 and is thereby fitted into the hood portion 21 of the female connector housing 20. That is, the connector fitting tapered surface 36 of the slide member 30 is engaged with the engaging projections 11 of the male connector housing 10 through the pressing 45 operation of the operation portion 31 of the slide member 30 and the male connector housing 10 can be thereby smoothly fitted into the hood portion 21 of the female connector housing 20. Therefore, for example, even when the male connector housing 10 is fitted into the female connector housing 20 with the male tab terminals 22 soldered to a base plate 40, there is no possibility that any stress or crack can be produced in the soldered portions of the male tab terminals 22 of the female connector housing 20 with respect to the base plate 40.

Figure 10A:
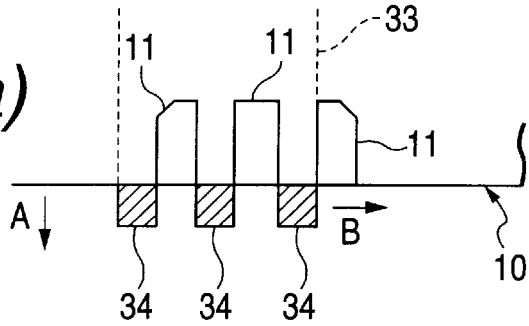
FIG. 10(*a*) is an explanatory view of the engaging projections of the male connector housing and the flexible securing projections of the slide member, showing a state thereof before they are engaged, FIG. 10(*b*) is an explanatory view of the above elements, showing a state thereof when they are engaged with each other.
Figure 10B:
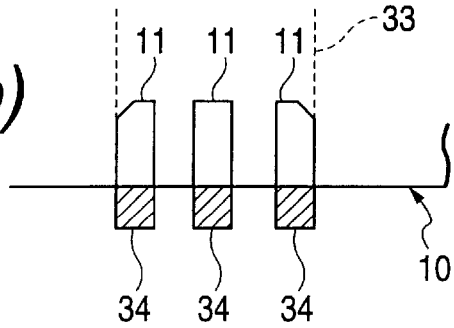
Figure 11:
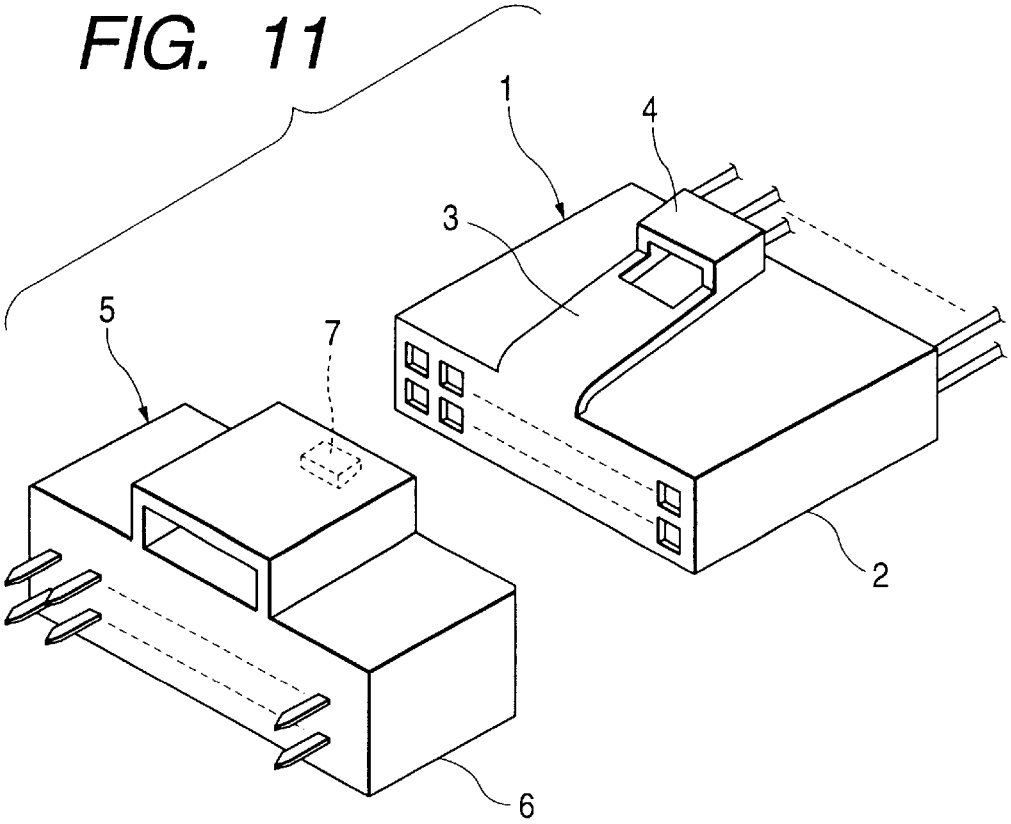
FIG. 11 is an exploded perspective view of a conventional connector locking structure.

And, as shown in FIG. 1, when the male connector housing 10 is fitted with the female connector housing 20, the three engaging projections 11 of the male connector housing 10 are respectively inserted through their associated three insertion grooves 25 of the hood portion 21 of the female connector housing 20, while the three engaging projections 11 are respectively restricted in position by the pair of guide ribs 24 forming the respective insertion grooves 25, so that the male connector housing 10 can be moved smoothly in a linear manner with respect to the female connector housing 20. Thanks to this, the two male and female connector housings 10 and 20 can be fitted together easily and smoothly and thus there is no fear that the male tab terminals 22 of the female connector housing 20 can be twisted and deformed. Also, as shown in FIG. 10(*a*), in the early stage of the fitting engagement of the two connector housings 10 and 20, since the three engaging projections 11 of the male connector housing 10 are situated between the three flexible securing projections 34 of the lock arm 33 of the slide member 30, the male connector housing 10 can be inserted smoothly into the hood portion 21 of the female connector housing 20; and, as shown in FIG. 10(*b*), at the time when the two connector housings 10 and 20 are fitted with each other through the pressing operation of the slide member 30, the three engaging projections 11 of the male connector housing 10 are respectively engaged (locked) by the three flexible securing projections 34 of the lock arm 3. To remove this locked condition, if the slide member 30 is moved by an amount corresponding to the width of one of the engaging projections in the opposite direction to an arrow B direction shown in FIG. 10(*a*), then the above-mentioned locked condition can be removed. Due to this, while securing the locking strength, the moving distance of the slide member 30 in the locked condition removing operation can be reduced. That is, only a small space is required to move the slide member 30, which makes it possible to make the connector more compact as a whole.

Figure 3:
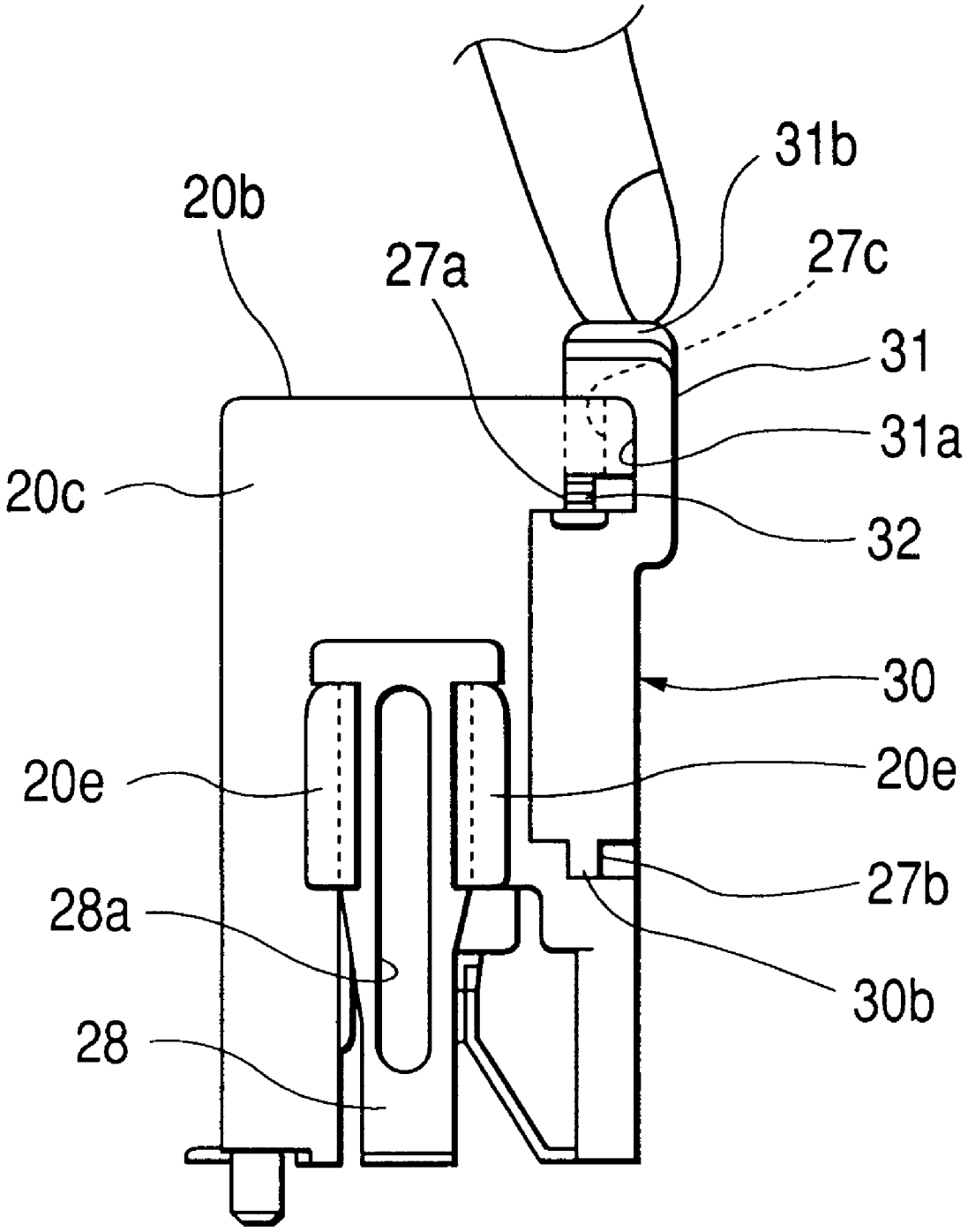
FIG. 3 is a side view of the female connector housing.
Figure 4:
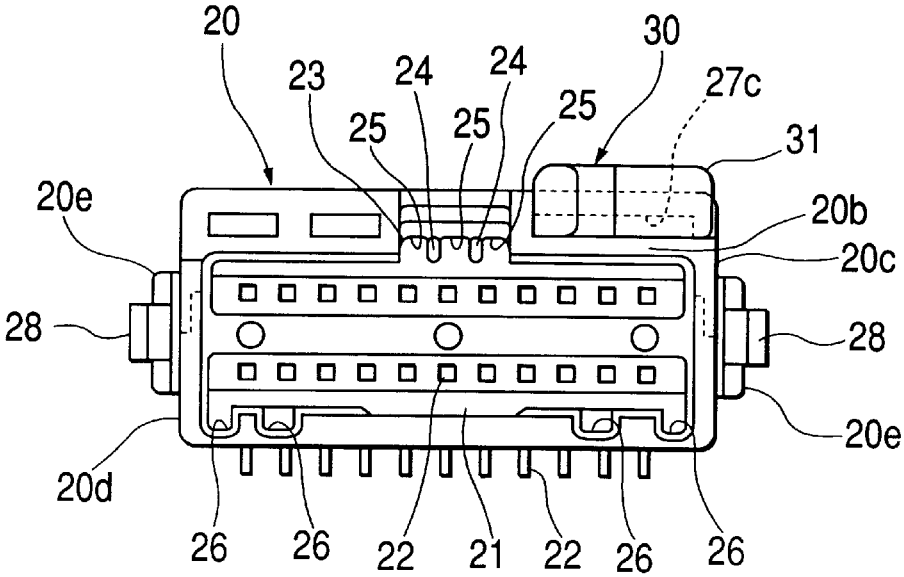
FIG. 4 is a front view of the female connector housing.
Figure 5:
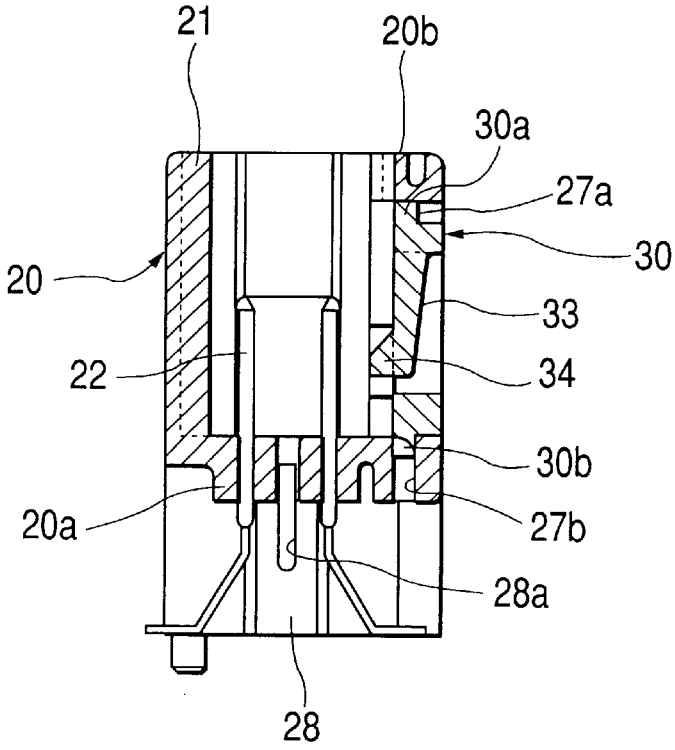
FIG. 5 is a section view of the female connector housing.

Also, in the pressing operation of the operation portion 31 of the slide member 30, as shown in FIG. 3, the operational pressing force of the operation portion 31 is supported mainly on the upper end face 20*b* side of the female connector housing 20 through the guide groove 31*a* of the operation portion 31 and, for this reason, the slide member 30 can be moved smoothly with no force in the rotation direction given thereto. Especially, since the guide groove 31*c* of the operation portion 31 is formed in a U shape, the slide member 31 can be slided smoothly without being rickety along the upper end face 20*b* of the female connector housing 20. Also, because the removal preventive securing projection 32 is provided on the lower surface side of the guide groove 31*a* of the operation portion 31, the slide member 30 is prevented from slipping off the upper end face 20*b* of the female connector housing 20; and also because the removal preventive securing projection 32 is inserted into the square-cylinder-shaped guide groove 27*c* formed on the upper end face 20*b* side of the female connector housing 20, the rickety motion of the slide member 30 in the rotation direction can be surely prevented, which makes it possible to execute the operation of the slide member 30 smoothly.

As has been described heretofore, in the connector locking structure according to the illustrated embodiment of the invention, in the slide member, there is formed the tapered surface for connector fitting engagement, and the tapered surface for connector fitting engagement is butted against the engaging projections of the male connector housing by means of the movement of the slide member to thereby allow the male connector housing to be fitted with the hood portion of the female connector housing automatically.

However, this is not limitative but, alternatively, in the slide member, there may be further formed a tapered surface for connector removal, and the tapered surface for connector removal may be butted against the engaging projections of the male connector housing by means of the movement of the slide member to thereby remove the male connector housing from the hood portion of the female connector housing automatically.

As has been described hereinbefore, according to the invention present invention, when the male and female connector housings are fitted with each other, a plurality of engaging projections provided in the male connector housing are respectively restricted in position by a plurality of insertion grooves formed in the hood portion of the female connector housing, which provides the following effect: that is, the male connector housing can be moved smoothly and in a straight manner with respect to the female connector housing, and thus the deformation and the like of the connector terminals can be surely prevented.

Also, according to the present invention, in the connector locked condition in which the plurality of engaging projections of the male connector housing are respectively engaged with the plurality of flexible securing projections of the slide member, a sufficient locking strength can be secured and, when removing such connector locked condition, if the slide member is moved by an amount equivalent to one engaging projection, then such connector locked condition can be removed. This provides an effect that the moving space of the slide member can be reduced and thus the whole connector can be made more compact by an amount corresponding to the reduction of the slide member moving space.

Further, according to the present invention, due to provision of the guide ribs forming the plurality of insertion grooves of the hood portion of the female connector housing, there is provided an effect that the male connector housing can be moved smoothly and positively in a straight manner with respect to the female connector housing, and thus the deformation and the like of the connector terminals can be surely prevented.

What is claimed is:

1. An electrical connector comprising:

a male electrical connector housing on which engagement projections are formed;

a female electrical connector housing having a hood portion in which passage grooves are formed, said hood portion adapted to receive said male electrical connector housing, such that said engagement projections pass completely through said passage grooves; and a slide member having an elastic retaining projection for engagement with said engagement projections, said slide member movably mounted on said hood portion;

wherein a number of said engagement projections of said male electrical connector housing corresponds to a number of said passage grooves of said female electrical connector housing.

2. The electrical connector as set forth in claim 1, wherein said slide member includes a plurality of elastic retaining projections corresponding in number to said engagement projections.

3. The electrical connector as set forth in claim 1, wherein said hood portion of said female electrical connector housing includes a guide rib interposing between adjacent passage grooves.

4. The electrical connector according claim 1, in which said slide member is slidable in a direction that is perpendicular to an insertion direction along which said male connector housing is insertable into said hood portion of said female electrical connector housing.

5. The electrical connector according to claim 1, wherein, while said male electrical connector housing is inserted into said hood portion, said engagement projections move relative to said passage groove in one direction only.

* * * * *